United States Patent [19]

Santanen et al.

[11] Patent Number: 4,921,275

[45] Date of Patent: May 1, 1990

[54] SKI POLE PROVIDED WITH A SNOW RING

[75] Inventors: Ensio Santanen, Helsinki; Esko Rauvala, Espoo, both of Finland

[73] Assignee: Exel OY, Helsinki, Finland

[21] Appl. No.: 286,538

[22] Filed: Dec. 19, 1988

[30] Foreign Application Priority Data

Dec. 21, 1987 [FI] Finland ..... 875614

[51] Int. Cl.[5] ..... A63C 11/24

[52] U.S. Cl. ..... 280/824

[58] Field of Search ..... 280/819, 824, 809

[56] References Cited

U.S. PATENT DOCUMENTS

| | | | |
|---|---|---|---|
| 3,645,553 | 2/1972 | Hinterholzer | 280/824 |
| 3,963,254 | 6/1976 | Aho | 280/824 |
| 4,221,392 | 9/1980 | Aho | 280/824 |
| 4,385,776 | 5/1983 | Pronzati | 280/824 |

FOREIGN PATENT DOCUMENTS

| | | | |
|---|---|---|---|
| 400107 | of 1924 | Fed. Rep. of Germany | 280/824 |
| 2027461 | 6/1978 | Fed. Rep. of Germany | 280/824 |
| 2952149 | 7/1981 | Fed. Rep. of Germany | . |

*Primary Examiner*—Charles A. Marmor
*Assistant Examiner*—Michael Mar
*Attorney, Agent, or Firm*—Price, Heneveld, Cooper, DeWitt & Litton

[57] ABSTRACT

A ski pole is provided with a space conserving foldable snow ring, said snow ring being a plastic moulding comprising a sleeve member and a basket member having a wing portion forming a bearing surface which can be pivoted between storage and working positions. The portion of the wing portion adjacent the sleeve can be flexed as the wing portion is pivoted between its working and storage positions. A bracket extends rearwardly from the sleeve member for detachably supporting and locking the wing portion in working position.

16 Claims, 2 Drawing Sheets

SKI POLE PROVIDED WITH A SNOW RING

The present invention relates to a ski pole provided with a space economically packable snow ring, said snow ring being produced as a one-piece, plastic moulding comprising a sleeve member and a basket member.

Many attempts have been made earlier to resolve the problem relating to the packing of ski poles provided with snow rings. One proposal involves the use of a loose snow ring that can be fastened to a separate sleeve. However, this solution involves a few problems. The snow ring must be packed separately which requires a separate package. Finding the right snow ring for a particular ski pole may be troublesome and also the assembly in retail store facilities has been found inconvenient. One problem is also the risk of losing the entire snow ring. If the attachment of a snow ring is left to the user, the skill and expertise of a user are often insufficient for mounting a snow ring. Patent specification No. DE 2400177 proposes a solution to the packing problem by omitting the side faces of a snow ring and by shaping the side edges for mutual gripping. In this case, one of the side edges of a snow ring extends laterally and requires considerable space in a package.

An object of the present invention is to provide a snow ring whereby the space requirement of a ski pole package can be substantially reduced and at the same time eliminate the need of attachment and the risk of losing a separate snow ring. In order to achieve this object, a snow ring of the invention is characterized by the features of the ring and sleeve being integral and of bendable material and the ring or basket member capable of being pivoted between a storage position extending in the general direction of the staff and a rearwardly extending position in conjunction with means for releasably securing it in this position.

The invention will now be described with reference made to the accompanying drawings, in which.

Figure 1:
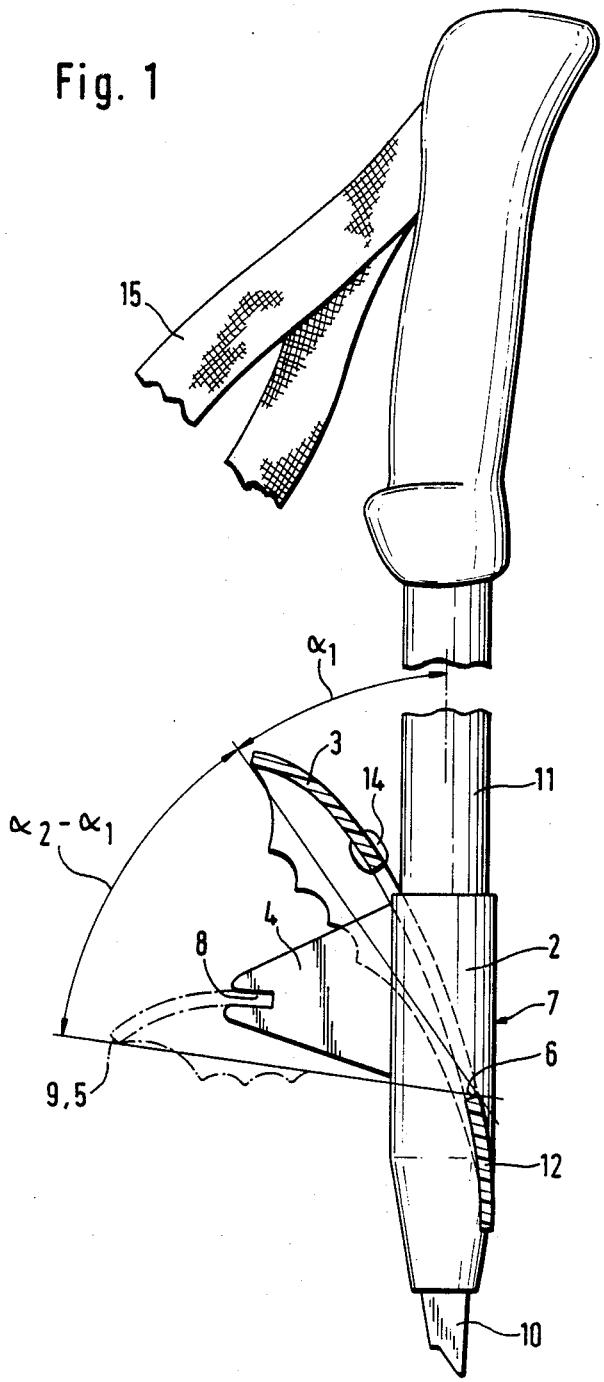
FIG. 1 is a side elevation view, partially sectioned of a ski pole provided with a snow ring of the invention in a packing condition.
Figure 2:
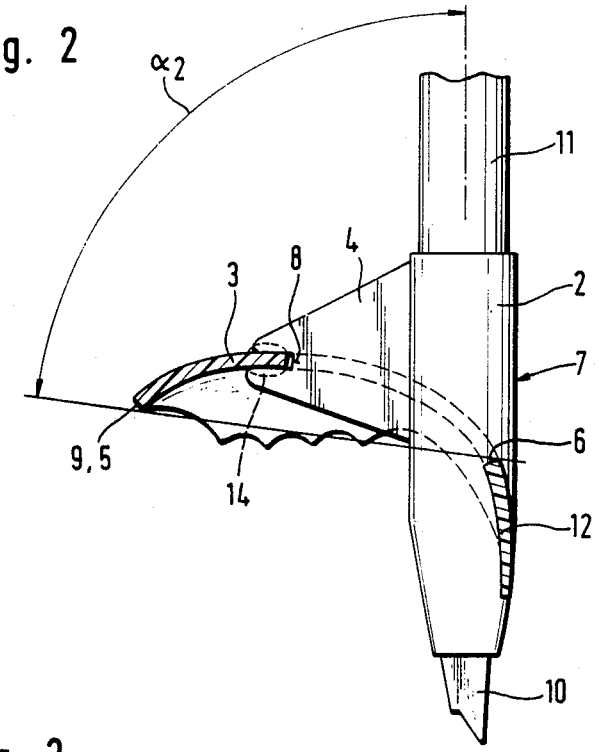
FIG. 2 shows the same ski pole as FIG. 1 with the snow ring bent to the position in which it is used.
Figure 3:
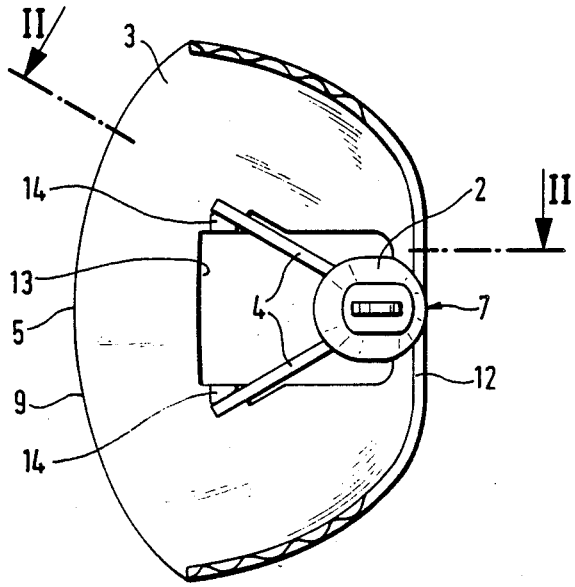
FIG. 3 shows the same ski pole as FIG. 2 as viewed from below.

Referring to FIGS. 1–3, reference numeral 1 designates a body produced as a single plastic moulding, comprising a sleeve member 2 and a basket member, the latter consisting of a wing portion 3 with its locking ribs 14 as well as of brackets 4 provided with locking grooves 8 and extending from the sleeve. A pole shaft 11 is secured inside the upper end of sleeve 2 and a stud 10 is fixed to the bottom end of sleeve 2. The snow ring or basket with its sleeve 2, is fastened to pole shaft 11 so that said wing portion 3 is located on the same side of a ski pole as the wrist strap 15. Thus, the wing portion 3 forms the actual bearing surface of a snow ring extending rearwardly from the leading edge of sleeve 2. The snow ring or basket has a front portion 12 which forms a downwardly curved gripping claw terminating in or adjacent to the face of the leading edge 7 of sleeve 2. In this context, this front portion 12 of the snow ring primarily refers to the portion of a snow ring connected to sleeve 2, the top edge of this juncture being indicated by reference numeral 6. The portion of a snow ring extending upward and rearward immediately therefrom along the sides of sleeve 2 defines a snow ring bending zone within which the snow ring or basket material bends as the snow ring is swung from packaging position (FIG. 1) to working position (FIG. 2).

The locking of a snow ring in its working position is effected by means of brackets 4, the number of which is preferably two. Said brackets 4 join at the base with sleeve 2 and are made of the same material as sleeve 2. The outer ends of brackets 4 are provided with locking grooves 8. Brackets 4 are preferably located in planes parallel to the longitudinal axis of sleeve 2, which planes form an angle relative to each other opening rearwardly from sleeve 2. As shown in FIG. 3, said wing portion 3 is provided with an opening 13 which, in the present embodiment, is rectangular in shape. The width of opening 13 is slightly less than the distance between the free ends of brackets 4 and their locking grooves 8. The edges of opening 13 are provided with locking ribs 14 behind which the locking grooves can be forced. The inherent tension of brackets 4 already tends to spread the locking grooves 8 toward the edges of opening 13 provided in the wing portion of the snow ring. However, engagement of the locking grooves 8 behind said ribs 14 with a sort of snap joint secures and locks of wing portion 3 in its working position even when a snow ring is subjected to asymmetrical loads. The upper edges of brackets 4 extend obliquely downward and thus do not become stuck in bushes and fence posts. The inclined upper edges of brackets 4 also facilitate the swinging of wing portion 3 to its working position, the angle between said brackets diminishing automatically as their upper edges respond to the edges of opening 13 during the swinging operation.

As pointed out above, the snow ring has a front portion 12 which forms a downwardly extending gripping claw for facilitating the fastening of a basket to the sleeve portion, preferably to the leading edge 7 of sleeve 2, over a relatively long length of attachment. In the packing position shown in FIG. 1, the plane extending between the upper end 6 of the point of attachment between front portion 12 of the snow ring and the sleeve 2 and the outermost portion 5 of the trailing edge 9 of wing portion 3 forms an acute angle $\alpha_1$ relative to the longitudinal axis of sleeve 2. The snow ring is manufactured by injection moulding in this packed or strange position thereof. In practice, such angle $\alpha_1$can even be considerably smaller than the one illustrated in FIG. 1. When bending wing portion 3 from, its packed position to working position, said angle $\alpha_1$increases as shown in FIG. 2 to form a substantially larger angle $\alpha_2$. The angle $\alpha_2$ between said plane and the longitudinal axis of the sleeve is, in the working position in circa 30°–80° larger than in the packed position and preferably in circa 35°–50° larger than in the packed position. Thus, the bending of material is not excessive but nevertheless sufficient to provide the required advantage of saving space. When bent and locked in the working position, the wing-shaped bearing surface 3 of a snow ring assumes a fixed working or operating position. In this fixed working position, said wing portion 3 only forms a bearing surface rearwards of the leading edge 7 of sleeve member 2 which serves to create a preferred snow ring design as described in patent specification No. FI 52816.

We claim:

1. A ski pole provided with shaft and a snow ring (1) capable of compact, space saving storage, said snow ring being produced as a one-piece plastic moulding comprising a sleeve member and a basket member, the bearing surface of which is formed by a wing portion (3) that can be pivoted downwardly from a storage position adjacent said shaft to its working position generally normal to and rearward of said shaft and locked in said position, characterized in that said wing portion (3), which is integrally attached at its forward portion to said sleeve member (2) can be pivoted between its storage and working positions by bending the plastic material of said wing portion (3), said sleeve member (2) being provided with rearwardly extending, laterally divergent locking and bracing means (4, 8) for locking and supporting said wing portion (3) in its working position, said means extending rearwardly generally normal to said shaft, said wing portion between its point of attachment to said sleeve (2) and its outermost trailing edge portion (9) when in the storage position forming an acute angle relative to the longitudinal axis of said sleeve member (2) and shaft with the portion of said basket member adjacent said sleeve member flexing to permit said pivotal movement.

2. A ski pole provided with a snow ring as set forth in claim 1, characterized in that the angle between the wing portion and the pole in the working position is preferably in the range of 35°-50° greater than it is when the wing portion is in the packing position.

3. A ski pole provided with a snow ring as set forth in claim 1, characterized in that when in said working position, the sleeve member forms a bearing surface extending only rearwards of the leading edge (7) of sleeve member (2), the point of bending being located along the sides of the sleeve member and the point of attachment to the sleeve member being located behind the leading edge area of the sleeve member.

4. A ski pole provided with a snow ring as set forth in claim 3, characterized in that the bracing means comprises a pair of brackets (4), said brackets each being located in a plane parallel to the longitudinal axis of sleeve (2) and said planes being divergent from each other rearwardly of said sleeve (2).

5. A ski pole provided with a snow ring as set forth in claim 1, characterized in that the bracing means comprises a pair of brackets (4), said brackets (4) being located in planes parallel to the longitudinal axis of sleeve (2) and said planes diverging from each other rearwardly of said sleeve.

6. A ski pole provided with a snow ring as set forth in claim 5, characterized in that said wing portion (3) is provided with an opening (13), located behind the sleeve member and extending at least partially along the sides of the sleeve member, said sleeve member (2) being located partially within said opening.

7. A ski pole provided with a snow ring as set forth in claim 6, characterized in that locking ribs being provided on the edges of the opening (13), said brackets (4) being so positioned that, when wing portion (3) is bent into its working position, said brackets (4) are located in said opening (13), whereby the locking grooves (8) made in said brackets (4) are set or can be pushed into engagement behind the locking ribs provided on the edges of opening (13).

8. A ski pole provided with as snow ring as set forth in claim 1, characterized in that said wing portion (3) is provided with an opening (13), located behind the sleeve member and extending rearwardly of said sleeve member, a portion of said sleeve member (2) being partially located in said opening (13).

9. A ski pole provided with a snow ring as set forth in claim 8, characterized in that said locking and bracing means are brackets (4) so positioned that, when said wing portion (3) is moved to its working position said wing portion having an opening (13) and said brackets (4) being located in said opening (13), said brackets having rearwardly opening locking grooves (8) for receiving and seating the rearward edge of said opening, and said wing portion having a pair of locking ribs spaced to receive said brackets between them.

10. A ski pole provided with a shaft and a space conserving foldable snow ring, said snow ring being a one-piece plastic molding comprising a sleeve member and a basket member, said basket member having a wing portion forming a bearing surface which surface adjacent its forward edge is integral with the sleeve member through a portion of said snow ring adjacent said sleeve capable of flexing whereby the wing portion can pivot between its rearwardly extending working position and its storage position adjacent said shaft, means extending rearwardly from said sleeve member for supporting and holding said wing portion in its working position, said rearwardly extending means having a latching element for detachable engaging said wing portion when the wing portion is in working position and detachably locking it in that position.

11. A ski pole provided with a shaft and a molded one piece plastic basket of resilient material, said basket having a sleeve member for securing it to the shaft, said basket having a wing portion capable of being pivoted about an axis adjacent the shaft between a working position extending outwardly and rearwardly from the shaft and a storage position adjacent the shaft, said wing portion extending entirely rearward of the forward edge of said sleeve member with the forward portion of said wing portion being integral with said sleeve adjacent the forward edge of said sleeve, said sleeve having a pair of brackets extending rearwardly from said shaft a distance substantially less than that of the rearward end of said wing portion of the basket, said brackets each having a rearwardly opening slot at its rearward end, said wing having an opening therethrough of a size and shape to receive said brackets therein, said opening extending rearwardly from said sleeve only to the forward ends of said slots whereby said basket upon being sufficiently flexed to be passed over the rearward ends of said brackets will become seated in said slots for detachably locking said basket in its rearwardly extending working position.

12. A ski pole having an upwardly extending shaft and provided with a space conserving foldable snow ring at the lower end of said shaft, said snow ring being a molded plastic body having limited resilience, said body having a sleeve member and a basket member, means at the front end of said basket member integrally joining said basket member to the front end of said sleeve member, said means being capable of flexing whereby said basket member can be pivoted between an operative position in which it extends rearwardly generally normal to the axis of said sleeve to a storage position in which it extends upwardly toward said shaft and is adjacent said sleeve member and at a minor angle thereto; latch means including a bracket extending rearwardly from said sleeve member having means at its rearward end for detachably engaging and holding said basket member when the basket member is in its operative position.

13. A ski pole as described in claim 12 wherein said latch means is a blind slot opening through the rear end of said bracket, said basket having a rearwardly extending opening for receiving said bracket when said basket member is moved to operative position and one of the bracket or the basket at the rear end of said slot is capable of being resiliently flexed to permit the basket member to pass over the end of said bracket and become seated in said slot.

14. A ski pole as described in claim 12 wherein a pair of said brackets are provided, said brackets being rearwardly divergent at a minor angle to provide support for said bracket at a pair of laterally spaced points.

15. A ski pole having a staff and a snow ring, said snow ring comprising, as one piece, a molded basket member and a sleeve member integral with each other, the portion of said basket integral therewith being located adjacent the front end of said sleeve member and being sufficiently flexible such that the basket member can be pivoted between an operating position extending rearwardly from said staff approximately normal thereto and a storage position extending generally lengthwise of said staff, anchor means extending normal to said staff in the same direction as said basket a portion of the rearward length of said basket and, when the basket is in operating position detachably anchoring said basket in such position, said basket being pivotable to said storage position through resilient deflection of its sides adjacent the sleeve member, said anchor means and said basket having interengaging latch means for detachably locking together said anchor means and said basket.

16. A ski pole provided with a space conserving foldable snow ring, said snow ring being a one-piece plastic molding comprising: a sleeve member and a basket member having a wing portion forming a bearing surface which can be pivoted between storage and working positions, said snow ring characterized in that adjacent its forward edge, said wing portion is integral with the sleeve member, that part of said wing portion adjacent said sleeve being capable of flexing as the wing portion is pivoted between its working and storage positions, means extending rearwardly from said sleeve member for supporting and holding said wing portion in a rearwardly extending working position, said rearwardly extending means having a latching element for detachably engaging said wing portion when said wing portion is in working position and locking it in that position, said wing portion having an opening behind the sleeve member and extending rearwardly a portion of the fore and aft length of the wing portion, said rearwardly extending means being a pair of rearwardly divergent brackets located in said opening, a pair of locking ribs provided at the edge of said opening, the rearward end of each of said brackets having a locking groove into which the rearward edge of the opening can be seated to secure the wing portion with each bracket seated against the outer side face of one of the locking ribs.

* * * * *